US012312886B2

(12) United States Patent
Andersen

(10) Patent No.: US 12,312,886 B2
(45) Date of Patent: May 27, 2025

(54) DOWNHOLE TOOL STRING

(71) Applicant: Welltec A/S, Allerød (DK)

(72) Inventor: Tomas Sune Andersen, Allerød (DK)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 18/303,433

(22) Filed: Apr. 19, 2023

(65) Prior Publication Data

US 2023/0340847 A1 Oct. 26, 2023

(30) Foreign Application Priority Data

Apr. 20, 2022 (EP) ..... 22169125
May 11, 2022 (EP) ..... 22172789

(51) Int. Cl.
*E21B 23/00* (2006.01)
*E21B 23/04* (2006.01)

(52) U.S. Cl.
CPC ..... *E21B 23/001* (2020.05); *E21B 23/0411* (2020.05)

(58) Field of Classification Search
CPC ... E21B 23/001; E21B 23/0411; E21B 43/112
See application file for complete search history.

(56) References Cited

U.S. PATENT DOCUMENTS 904,657 A * 11/1908 Stephens ..... E21B 43/112 166/55.3
1,804,819 A 5/1931 Spencer, Jr. et al.
(Continued)

FOREIGN PATENT DOCUMENTS

EP 2505768 A1 10/2012
EP 2813665 A1 12/2014
(Continued)

OTHER PUBLICATIONS

International Search Report and Written Opinion mailed Jul. 18, 2023 in International Application No. PCT/EP2023/060137, 13 pages.
(Continued)

*Primary Examiner* — D. Andrews
(74) *Attorney, Agent, or Firm* — Nixon & Vanderhye P.C.

(57) ABSTRACT

The present invention relates to a downhole tool string for displacing at least a tool section in a well in a radial direction in a wall of a well tubular metal structure extending along an axial direction in relation to the radial direction, comprising a tool body having an outer face and a tool centre axis along the axial direction, a centre plane extending along and enclosing the centre axis, dividing the tool body into a first body half and a second body half, an operational machining tool for performing a machining operation in the well tubular metal structure, such as drilling a hole in the wall, and extendable from the outer face of the first body half in a first radial direction in relation to the tool centre axis, and a first displacement element extendable from the outer face of the second body half of the tool body for displacing the tool body towards the wall for arranging the operational machining tool close to the wall, the first displacement element being extendable between a retracted position and a projected position, wherein the downhole tool string further comprises a first distancing element extendable from the outer face of the first body half, the first distancing element having a retracted position and a projected position, and in the projection position of the first distancing element a distance is provided between the outer face and the wall of the well tubular metal structure. Moreover the present invention also relates to a downhole system.

16 Claims, 9 Drawing Sheets

(56) References Cited

U.S. PATENT DOCUMENTS

Figure 1:
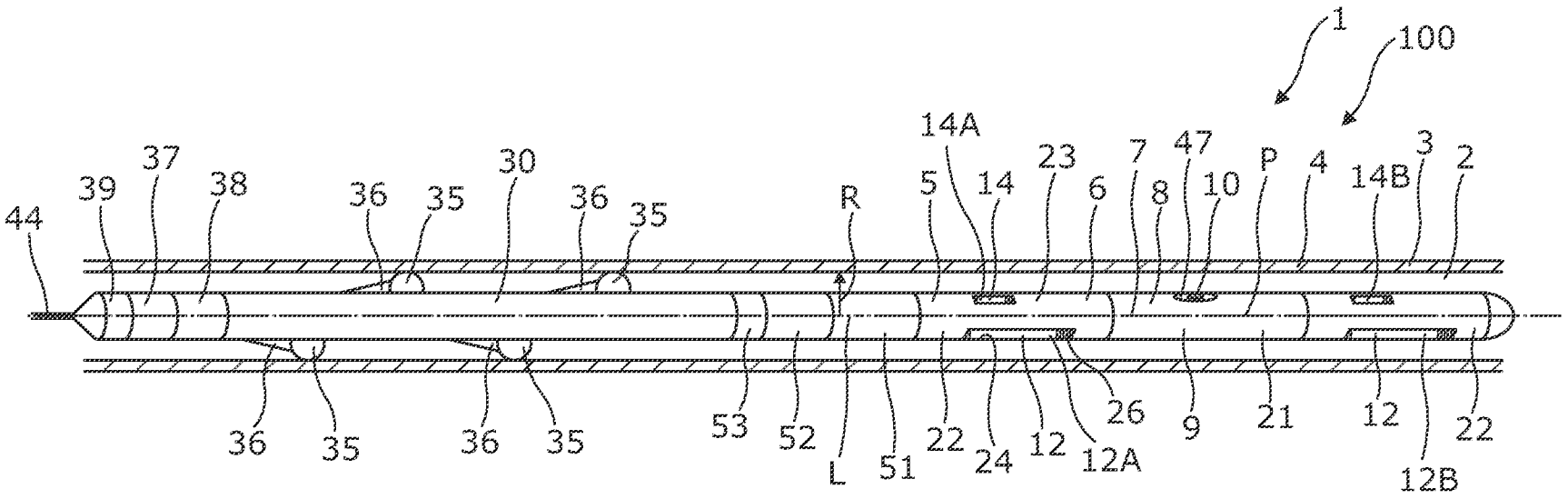

| | | | | |
|---|---|---|---|---|
| 3,177,938 | A | 4/1965 | Rene | |
| 3,831,443 | A | 8/1974 | Planche | |
| 2009/0223659 | A1 | 9/2009 | Hill et al. | |
| 2015/0285017 | A1 | 10/2015 | Coles et al. | |
| 2017/0030157 | A1* | 2/2017 | Hansen | E21B 34/08 |
| 2017/0350193 | A1* | 12/2017 | Andersen | E21B 41/0085 |
| 2021/0340830 | A1 | 11/2021 | Hallundbæk | |

FOREIGN PATENT DOCUMENTS

| | | | |
|---|---|---|---|
| WO | 2008091157 | A1 | 7/2008 |
| WO | 2009014932 | A2 | 1/2009 |
| WO | 2017211825 | A1 | 12/2017 |

OTHER PUBLICATIONS

Extended European Search Report for EP Application No. 22172789.4 mailed Oct. 14, 2022, 9 pages.

* cited by examiner

DOWNHOLE TOOL STRING

CROSS-REFERENCE TO RELATED APPLICATIONS

This application claims priorities to EP patents application Ser. Nos. 22/169,125.6 filed Apr. 20, 2022, and 22172789.4 filed May 11, 2022, the entire contents of which are hereby incorporated by reference.

The present invention relates to a downhole tool string for displacing at least a tool section in a well in a radial direction in a wall of a well tubular metal structure extending along an axial direction in relation to the radial direction. Moreover, the present invention also relates to a downhole system.

When performing a drilling of a hole in a casing in an oil or gas well, the tool section comprising the drill bit is displaced in a radial direction perpendicular to the axial extension of the casing. However, tests have shown that the drill bit sometimes breaks.

It is an object of the present invention to wholly or partly overcome the above disadvantages and drawbacks of the prior art. More specifically, it is an object to provide an improved tool string having an operational machining tool, such as a drill bit, able to extend radially and perform the machining operation without breaking.

The above objects, together with numerous other objects, advantages and features, which will become evident from the below description, are accomplished by a solution in accordance with the present invention by a downhole tool string for displacing at least a tool section in a well in a radial direction in a wall of a well tubular metal structure extending along an axial direction in relation to the radial direction, comprising:

- a tool body having an outer face and a tool centre axis along the axial direction, a centre plane extending along and enclosing the centre axis, dividing the tool body into a first body half and a second body half,
- an operational machining tool for performing a machining operation in the well tubular metal structure, such as drilling a hole in the wall, and extendable from the outer face of the first body half in a first radial direction in relation to the tool centre axis, and
- a first displacement element extendable from the outer face of the second body half of the tool body for displacing the tool body towards the wall for arranging the operational machining tool close to the wall, the first displacement element being extendable between a retracted position and a projected position, wherein the downhole tool string further comprises a first distancing element extendable from the outer face of the first body half for ensuring a distance between the outer face and the wall of the well tubular metal structure when the first displacement element is in the projected position, the first distancing element having a retracted position and a projected position.

Thus the downhole tool string for displacing at least a tool section in a well in a radial direction in a wall of a well tubular metal structure extending along an axial direction in relation to the radial direction may comprise:

- a tool body having an outer face and a tool centre axis along the axial direction, a centre plane extending along and enclosing the centre axis, dividing the tool body into a first body half and a second body half,
- an operational machining tool for performing a machining operation in the well tubular metal structure, such as drilling a hole in the wall, and extendable from the outer face of the first body half in a first radial direction in relation to the tool centre axis, and
- a first displacement element extendable from the outer face of the second body half of the tool body for displacing the tool body towards the wall for arranging the operational machining tool close to the wall, the first displacement element being extendable between a retracted position and a projected position, wherein the downhole tool string further comprises a first distancing element extendable from the outer face of the first body half, the first distancing element having a retracted position and a projected position, and in the projection position of the first distancing element a distance is provided between the outer face and the wall of the well tubular metal structure.

The operational machining tool may be a drill bit for cutting a hole in the well tubular metal structure by rotating around its own centre axis.

Thus, the downhole tool string may be a hole-drilling downhole tool string for drilling at least one hole in the wall of the well tubular metal structure.

Also, the distance may be less than 10 mm, preferably less than 5 mm.

Further, the operational machining tool may be a drill bit.

In addition, the operational machining tool may have abrasive inserts or cutting inserts.

Moreover, the first displacement element in the projected position may extend from the outer face at a first length, the first distancing element in the projected position extending from the outer face at a second length, and the first length being longer than the second length.

Furthermore, the first length may be more than 200% of the second length, preferably more than 300%, more preferably more than 400%, and even more preferably more than 500%.

In addition, the operational machining tool in a projected position may have a third length before initiating the machining operation, the second length being less than 50% of the third length.

Moreover, the operational machining tool in an initial projected position may have a fourth length before initiating the machining operation, the fourth length being equal to or shorter than the second length.

Further, the fourth length may be less than 10 mm, preferably less than 5 mm.

Also, the first distancing element may be arranged at an angle of 0-±90° from the operational machining tool along a circumference of the tool body, preferably at an angle of 5-±45° from the operational machining tool.

Additionally, the first displacement element and the first distancing element may be projectable by the same axial movement in the tool body.

Moreover, the first displacement element and the first distancing element may be projectable by means of hydraulics.

In addition, the first displacement element and the first distancing element may be projectable by means of a piston inside the tool body.

Furthermore, the first displacement element and the first distancing element may be projectable by means of a spindle or wedges inside the tool body.

The present invention may further comprise a second displacement element projecting from the second body half and arranged at an angle of 0-120° from the first displacement element along a circumference of the tool body, preferably at an angle of 5-120° from the first displacement element, and more preferably at an angle of 20-120° from the first displacement element.

Also, the present invention may further comprise a second distancing element projecting from the first body half and arranged at an angle of 0-120° from the first distancing element along a circumference of the tool body, preferably at an of angle 5-120° from the first distancing element, and more preferably at an angle of 20-120° from the first distancing element.

Moreover, the first and second distancing element may be equidistantly placed around the first radial direction.

Additionally, the displacement element and the distancing element may be projectable from the outer face by pivoting around each their respective pivot points.

Further, the displacement element and the distancing element may be projectable from the outer face by being displaceable radially outwards.

Also, the tool body may have an outer diameter of less than 79 mm, preferably less than 54 mm, i.e. less than 2.125 inches.

Furthermore, the downhole tool string may comprise a first tool section in which the operational machining tool is arranged and a second tool section in which the displacement element and the distancing element are arranged.

In addition, the second tool section may be an anchoring section, the displacement element and the distancing element being anchoring elements.

Moreover, the displacement element and the distancing element may have a first end connected with the tool body and a second end for abutment to the wall of the well tubular metal structure.

Additionally, each second end of the displacement element and the distancing element may comprise a friction-enhancing element, such as teeth.

Also, the downhole tool string may comprise a tool housing having a first opening through which the distancing element projects and a second opening through which the displacement element projects.

Further, the pivot point around which the displacement element rotates may be in the form of a shaft which is rotatably connected to the tool housing.

Moreover, the pivot point around which the distancing element rotates may be in the form of a shaft which is rotatably connected to the tool housing.

Finally, the present invention also relates to a downhole system comprising the downhole tool string and a driving unit, such as a downhole tractor, for propelling the downhole tool string forward in the well.

Figure 2A:
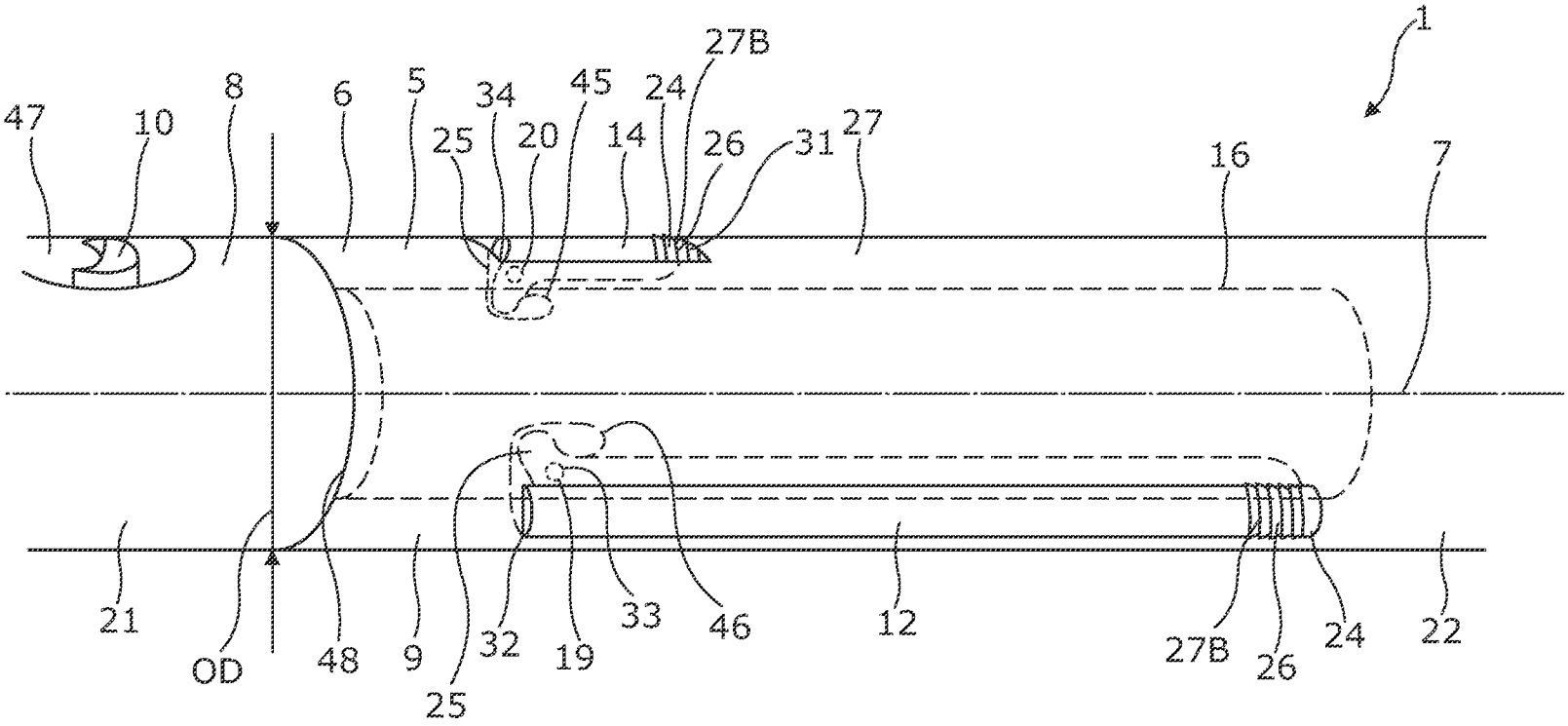
Figure 2B:
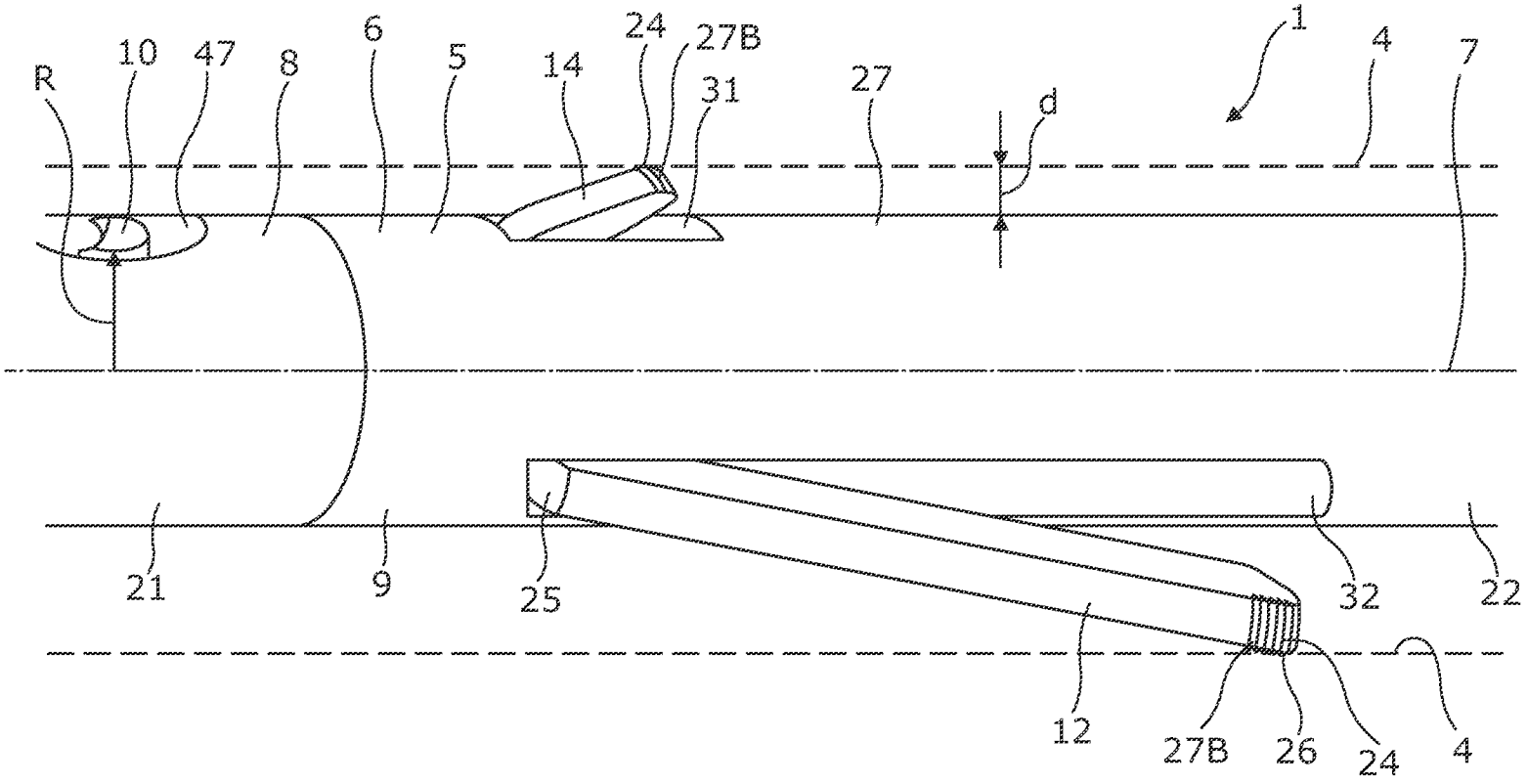
Figure 3:
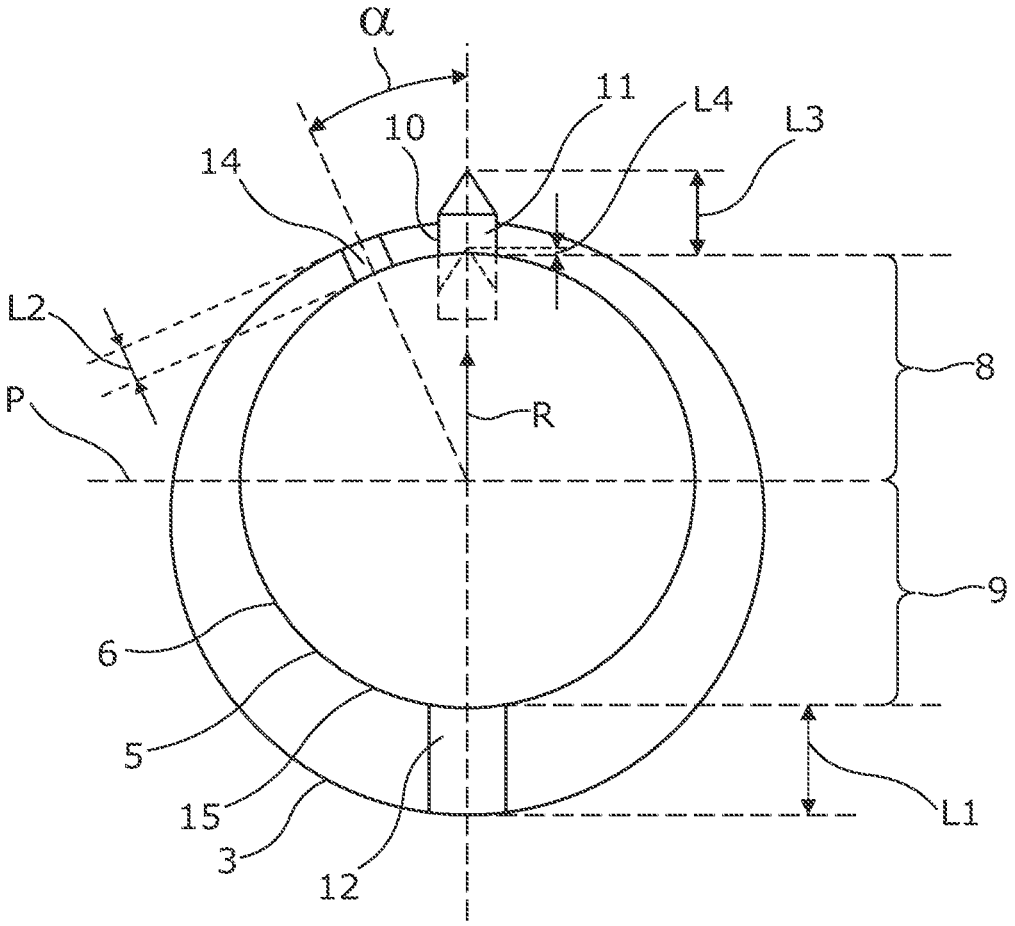
Figure 4:
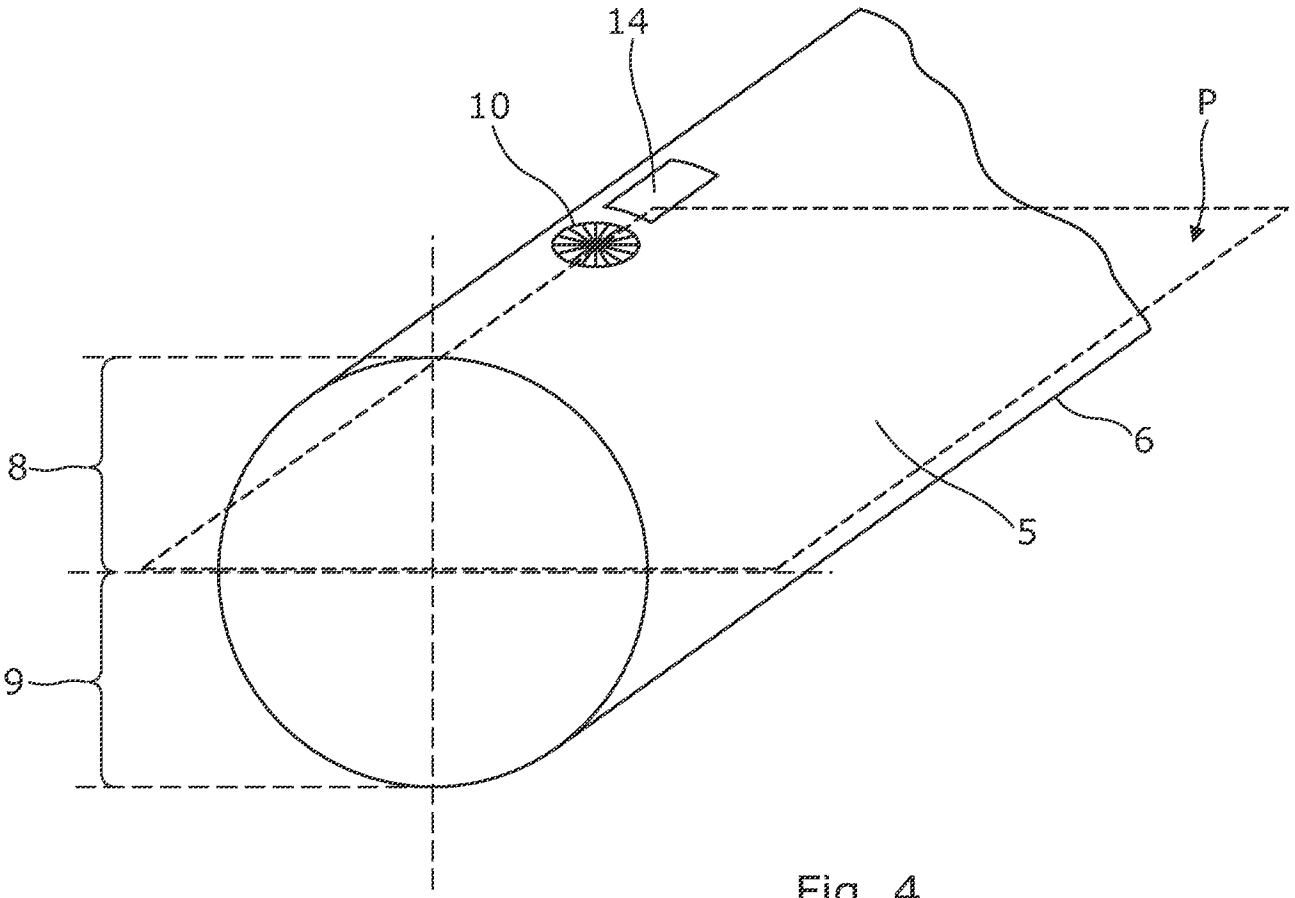
Figure 5:
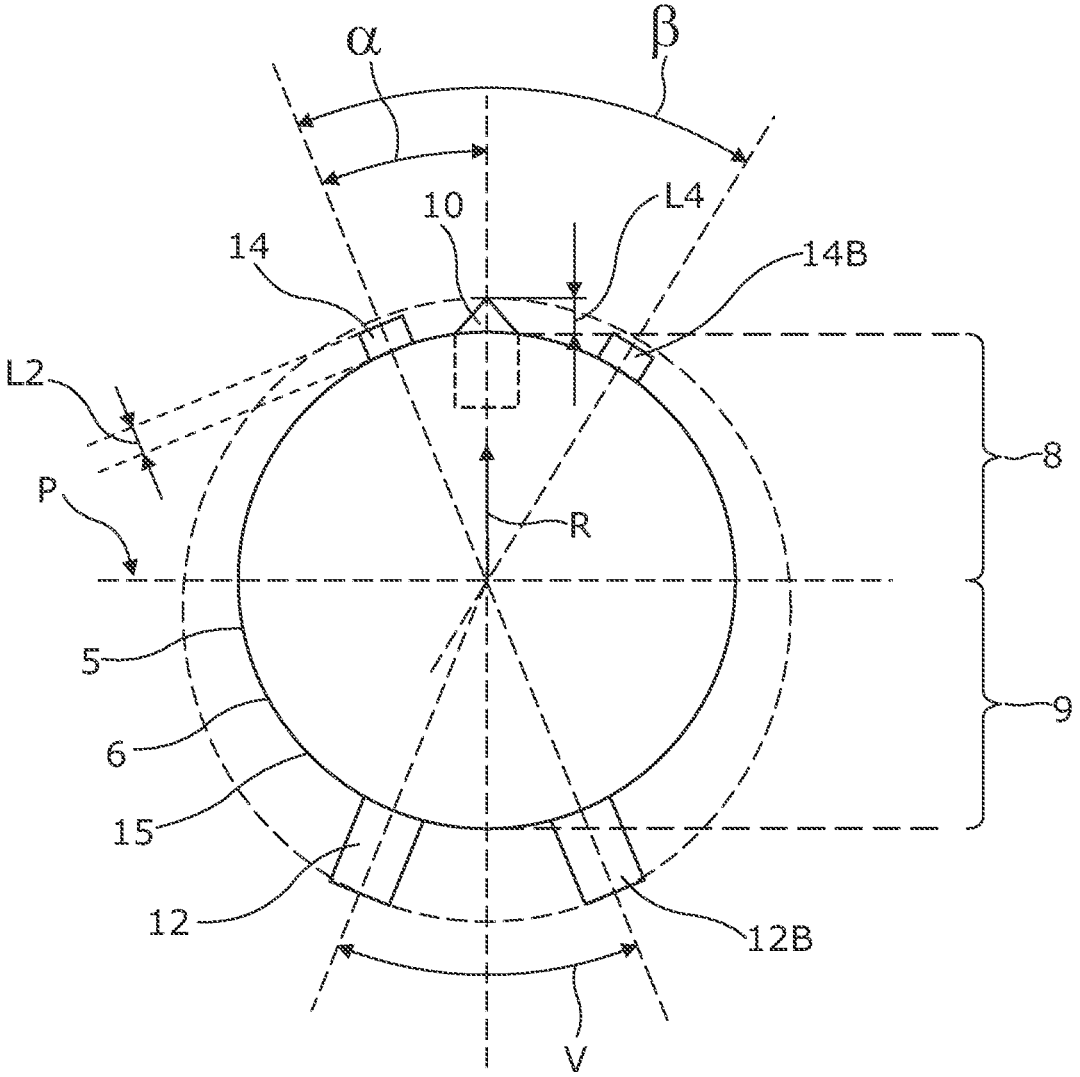
Figure 6A:
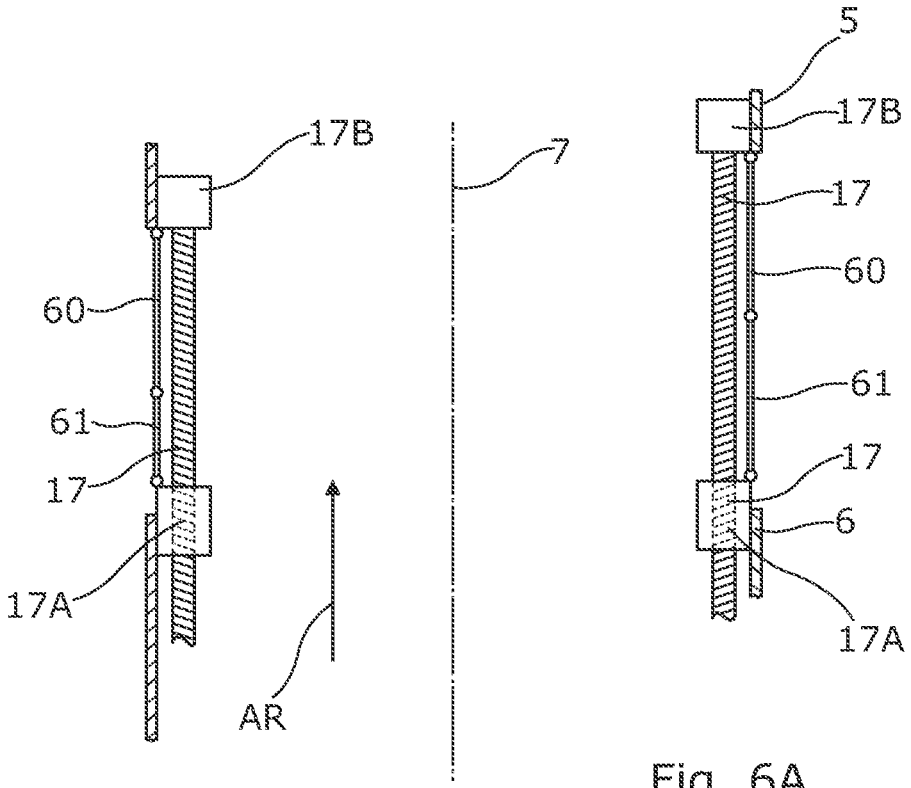
Figure 6B:
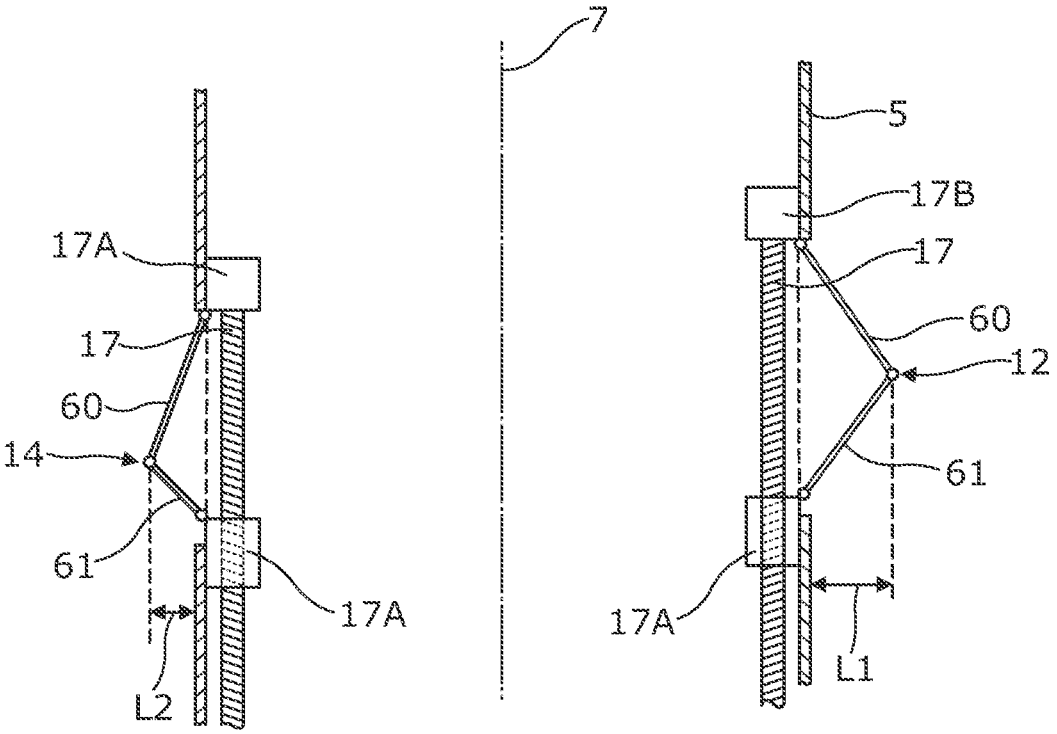
Figure 7A:
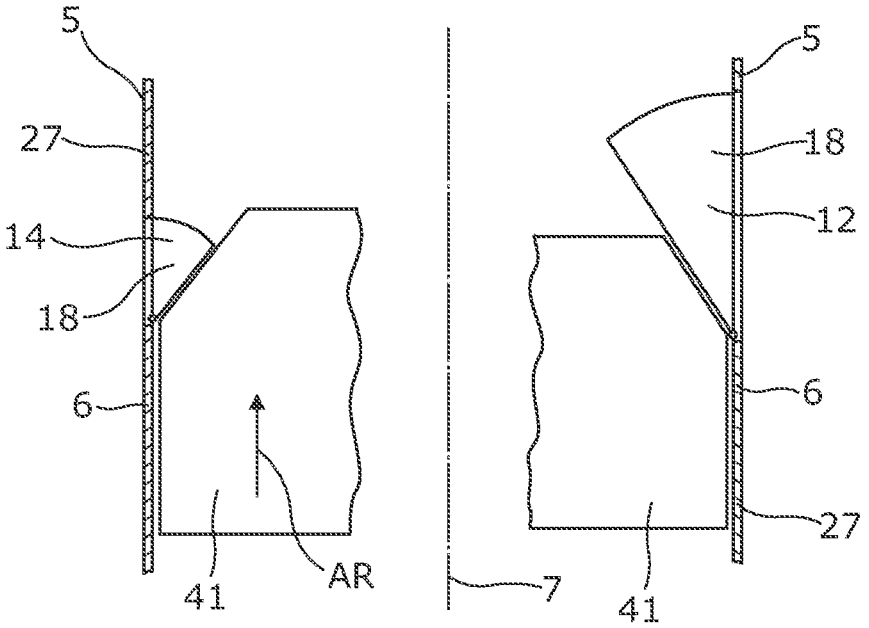
Figure 7B:
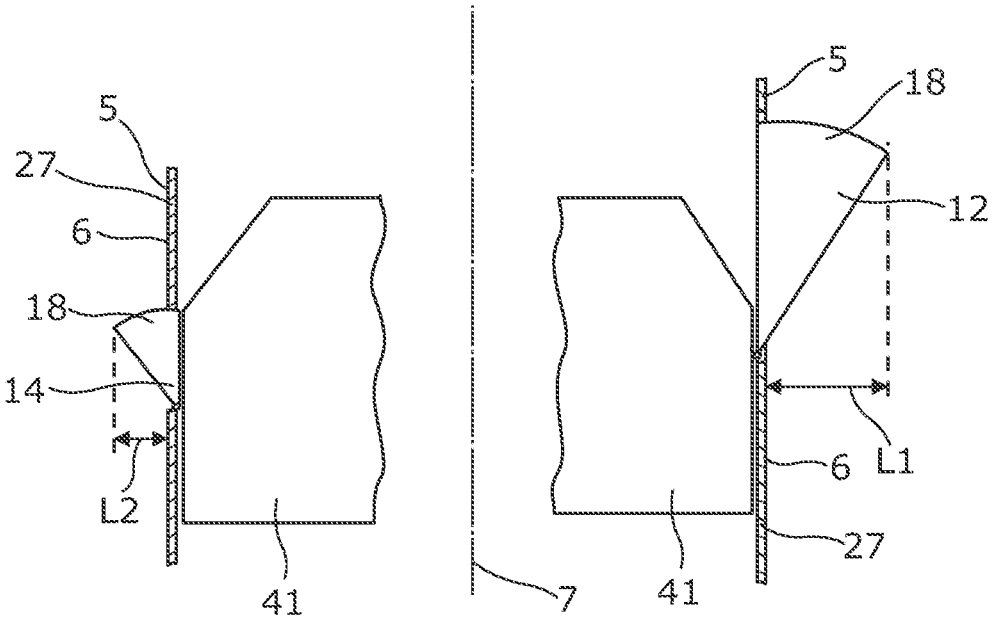
Figure 8A:
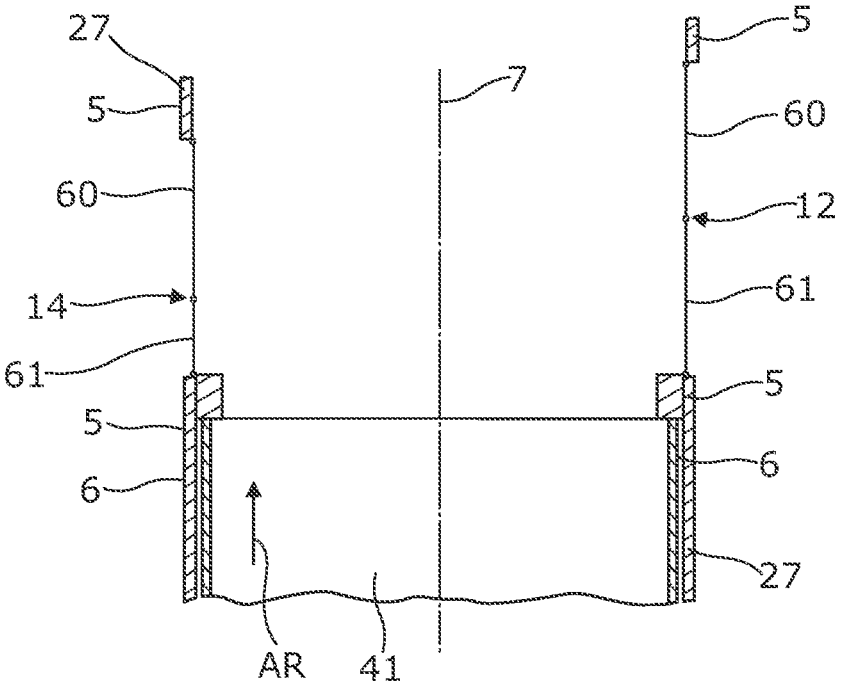
Figure 8B:
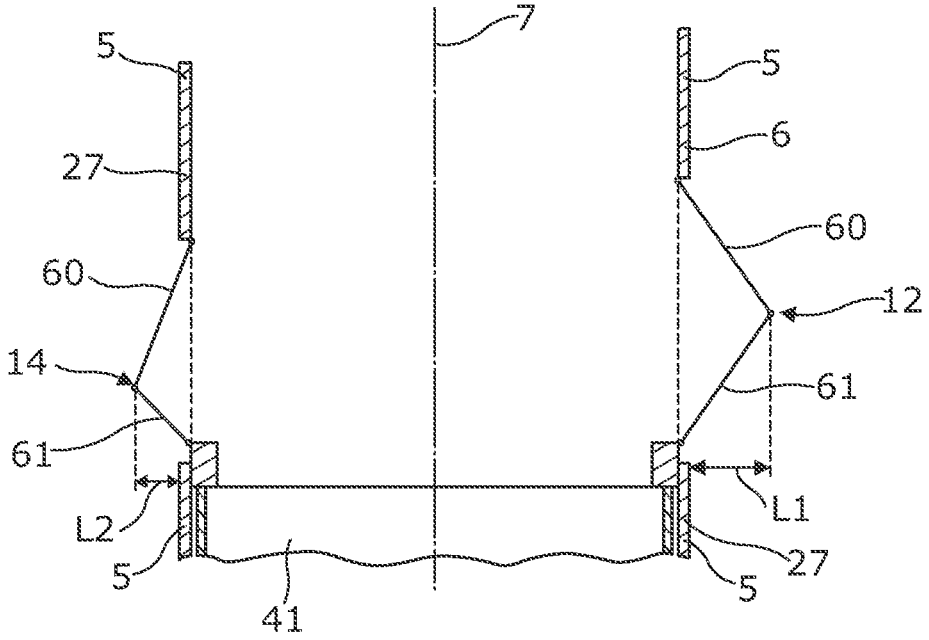

The invention and its many advantages will be described in more detail below with reference to the accompanying schematic drawings, which for the purpose of illustration show some non-limiting embodiments and in which:

FIG. 1 shows a downhole tool string in a well tubular metal structure of a well, FIG. 2A shows a part of another downhole tool string having an operational machining tool, displacement elements and a distancing element in a retracted position, FIG. 2B shows the downhole tool string of FIG. 2A in which the displacement elements and the distancing element are shown in a projected position, FIG. 3 shows a schematic illustration of a front view of another downhole tool string in a well tubular metal structure in which the operational machining tool, the displacement element and the distancing element are shown in their projected position, FIG. 4 shows a part of another downhole tool string comprising an operational machining tool and a distancing element in a first body half above a centre plane, FIG. 5 shows a schematic illustration of a front view of yet another downhole tool string comprising an operational machining tool, two displacement elements and two distancing elements, where the displacement elements and the distancing elements are shown in their projected position, FIGS. 6A and 6B show a schematic illustration of another downhole tool string comprising a spindle for moving the displacement element and the distancing element from a retracted position shown in FIG. 6A to their projected position shown in FIG. 6B, FIGS. 7A and 7B show a schematic illustration of yet another downhole tool string comprising wedges for moving the displacement element and the distancing element from a retracted position shown in FIG. 7A to their projected position shown in FIG. 7B, and FIGS. 8A and 8B show a schematic illustration of yet another downhole tool string comprising an axial sliding mandrel for moving the displacement element and the distancing element from a retracted position shown in FIG. 8A to their projected position shown in FIG. 8B.

All the figures are highly schematic and not necessarily to scale, and they show only those parts which are necessary in order to elucidate the invention, other parts being omitted or merely suggested.

FIG. 1 shows a downhole tool string 1 for displacing at least a tool section or the whole downhole tool string itself in a well 2 in a radial direction R in a wall 3 of a well tubular metal structure 4 extending along an axial direction L in relation to the radial direction. The downhole tool string 1 comprises a tool body 5 having an outer face 6 and a tool centre axis 7 along the axial direction. FIG. 1 shows a centre plane P extending along and enclosing the tool centre axis 7, dividing the tool body into a first body half 8 and a second body half 9. The downhole tool string 1 further comprises an operational machining tool 10 for performing an operation in the well tubular metal structure, such as a machining operation in the form of drilling a hole 11 (shown in FIG. 3) in the wall of the well tubular metal structure, such as a production casing. The downhole tool string 1 may thus be used to make several holes forming a perforated zone for letting production fluid, i.e. hydrocarbon-containing fluid such as oil or gas, into the well tubular metal structure. The operational machining tool 10 is extendable from the outer face of the first body half in the first radial direction R in relation to the tool centre axis, and the operational machining tool 10 is arranged in an opening 47 in a tool housing 27. The downhole tool string 1 further comprises a first displacement element 12, 12A extendable from the outer face of the second body half of the tool body for displacing the tool body towards the wall 3 for arranging the operational machining tool 10 close to the wall. The first displacement element is extendable between a retracted position, as shown in FIG. 1, and a projected position, shown in FIG. 2B. The downhole tool string further comprises a first distancing element 14, 14A extendable from the outer face of the first body half for ensuring a distance d (shown in FIG. 2B) between the outer face 6 and the wall 3 of the well tubular metal structure 4 when the first displacement element 12 is in the projected position. The first distancing element 14 has a retracted position as shown in FIGS. 1 and 2A and a projected position as shown in FIG. 2B.

When performing a machining operation such as drilling a hole in the wall of a production casing, the drilling process generates swarf, and if the distancing element 14 did not ensure that a certain distance between the outer face 6 of the tool body and the wall is maintained, the swarf would accumulate around the drill bit and would have no room for leaving the drilling zone, and the drilling operation would eventually stop as the accumulating swarf would fasten around the drill bit, hindering further rotation. Thus, by having the distancing element providing and ensuring the distance, the swarf is able to leave the drilling zone, and the drilling operation is thus no longer stopped as the swarf does not accumulate around the bit. Furthermore, by having the distance, well fluid is able to flush through the operational zone, thereby moving the swarf from the drill bit, and the heat provided by the drilling operation is easily distributed away from the drill bit.

For safety reasons, the operators would like to avoid explosives in the well, and therefore there has been an increasing wish to be able to make the perforated zones in the well by machining the holes. Prior art machining tools in downhole tool strings have been made with as long an extension as possible and with the machining tools positioned as close as possible to the object into which they are to machine in order to provide the longest reach; however, sometimes these machining operations have failed for unknown reasons. Thus, in prior art tools the focus has been on getting as close to the object and providing as long an extension into the object as possible. A distancing element provides the opposite: a shorter reach into the object to be machined, but the machining operation does not fail as often as with the prior art tools. Thus, the initial position of the machining tool is to have only a very short length L4, if any, from the outer face of the tool body, as illustrated by dotted lines in FIG. 3.

Especially when machining by a rotating drill bit, the swarf is rotated with the bit and has proved to have a tendency to get stuck between the drill bit and the hole wall of the hole which is drilled by the drill bit. Drilling holes by means of a drill bit is safer than by perforating a zone by means of explosives, but one drill bit needs to be able to drill several holes in order to "compete" with the explosives in relation to the time spent on the perforation operation.

FIG. 3 shows a cross-sectional view of the tool body 5 positioned in a well having a wall 3. The first displacement element 12 is shown in the projected position extending from the outer face 6 of the tool body 5, i.e. extending a first length L1. The first displacement element 12 is positioned in the second body half 9 of the tool body 5. The first distancing element 14 is shown in the projected position in the first body half 8 of the tool body 5. The first distancing element 14 extends a second length L2 from the outer face 6 of the tool body 5. In FIG. 3, the first length L1 is longer than the second length L2. The first length L1 may be more than 200% of the second length, preferably more than 300%, more preferably more than 400%, and even more preferably more than 500%.

In FIG. 3, the first distancing element 14 is arranged at an angle $\alpha$ of approximately 20° from the operational machining tool 10. In another embodiment, the first distancing element may be arranged in angles $\alpha$ of 0-±90° from the operational machining tool along a circumference 15 of the tool body 5. In FIG. 4, the angle is 0° in relation to the operational machining tool 10, i.e. the operational machining tool and the distancing element 14 are coincident along the circumference of the tool body.

The operational machining tool 10 is projecting along a radial direction R perpendicularly to the tool centre axis 7, and the plane P divides the first body half 8 and the second body half 9 of the tool body 5. It is shown that the operational machining tool 10 projects into the wall 3 of the well when having drilled or punched a hole 11 in the wall of the well tubular metal structure 4. In a projected position, the operational machining tool 10 has a third length L3. The second length L2 is less than 50% of the third length L3.

As shown in FIG. 2A, the first displacement element 12 and the first distancing element 14 are projectable by the same axial movement in the tool body 5. In FIG. 2A, the same axial movement is provided by a piston 16 (indicated by dotted lines) inside the tool body 5 moving along the tool centre axis 7 and connected to both the first displacement element 12 and the first distancing element 14. The piston 16 comprises a first aperture 45 (indicated by dotted lines) receiving a first end 25 of the distancing element 14 and a second aperture 46 (indicated by dotted lines) receiving the first end 25 of the displacement element 12. The piston 16 is moved along the tool centre axis 7 by means of hydraulics by a pressurised fluid pressing onto a piston face 48 (indicated by dotted lines). The displacement element 12 and the distancing element 14 are projectable from the outer face 6 by pivoting around their respective pivot points 19, 20 (indicated by dotted lines). The pivot point 19 around which the displacement element 12 rotates is in the form of a pin 33 which is rotatably connected to an inner face of the tool housing 27, and the pivot point around which the distancing element 14 rotates is in the form of a pin 34 (indicated by dotted lines) which is rotatably connected to an inner face of the tool housing 27. The tool housing is stationary while the piston moves, and the displacement element 12 and the distancing element 14 are thus forced to project as the piston provides the same axial movement. As shown in FIG. 1, the downhole tool string 1 comprises a pump 51 to allow pressurised fluid to move the piston and to move the operational machining tool radially outwards. The downhole tool string 1 further comprises a compensator 52 for ensuring a small overpressure inside the tool string compared to the well pressure. The downhole tool string 1 further comprises an electric motor 53 driving the pump and via a shaft rotating the drill bit by means of gears (not shown). The piston 16 illustrated by dotted lines in FIG. 2A is retracted by means of a spring (not shown) partly inside the piston so that when the piston is moved by means of the pressurised fluid, the piston compresses the spring, and when the pressure is released, the spring decompresses, moving the piston to its initial position and thus moving the displacement element 12 and the distancing element 14 to their retracted position.

As shown in FIG. 1, the downhole tool string 1 may have a driving unit 30, such as a downhole tractor, where wheels 35 on wheel arms 36 provide a certain and approximately even distance from the tool body 5 to the wall 3. In order to displace the tool body in relation to the wall 3 as shown in FIGS. 2B, 3 and 5 where the first body half 8 of the tool body 5 is moved closer to the wall 3 than the second body half 9, the downhole tool string may be controlled to retract the wheel arms so that displacement is possible. In another embodiment, the downhole tool string may have a tool section enabling displacement of the first part of the downhole tool string having the machining tool 10 while the second part of the downhole tool string having the driving unit 30 is maintained centralised.

FIG. 6A shows a retracted position, i.e. a first position, of the first displacement element 12 and the first distancing element 14. FIG. 6B shows a projected position, i.e. a second position, of the first displacement element 12 and the first distancing element 14. The first displacement element 12 and the first distancing element 14 are projectable by means of a spindle 17 rotating inside the tool body 5.

Rotating the spindle 17 and thereby moving a movable spindle part 17A towards a fixed spindle part 17B will cause the displacement element 12 and the distancing element 14 to project outwardly from the tool body 5. In FIGS. 6A and 6B, the displacement element and the distancing element comprise parts 60, 61 of different lengths, and hence the first length L1 and the second length L2 will become different in the projected state of the displacement element 12 and the distancing element 14.

FIGS. 7A and 7B show a downhole tool string in which the displacement element 12 and the distancing element 14 are projectable by means of a mandrel 41 driven by an electric motor (not shown). The mandrel interacts with the wedges 18 of the displacement element 12 and the distancing element 14 in that the displacement element 12 and the distancing element 14 are wedge-shaped. The mandrel 41 has an inclined face abutting the wedged displacement element 12 and the wedged distancing element 14, but in another embodiment the mandrel could have a non-inclining shape. In FIGS. 7A and 7B, the size of the wedges 18 are different, and thereby it is achieved that the displacement element 12 projects more than the distancing element 14. The wedges are connected to the tool housing 27 in a pivot point and retracted by a torsional spring arranged in the pivot point. The mandrel 41 is moved by a hydraulic pressure, an internal spring is compressed, and as the mandrel forces the wedge outwards, the torsional spring is stretched. When the hydraulic pressure is released, and the internal spring is retracting the mandrel, the torsional spring retracts the wedge.

FIG. 7A shows the wedges 18 and thus the displacement element 12 and the distancing element 14 in a retracted position, i.e. a first position. FIG. 7B shows the wedges 18 and thus the displacement element 12 and the distancing element 14 in a projected position, i.e. a second position. The wedges 18 are moved from the retraced position to the projected position by pushing the mandrel 41 in the direction of an arrow AR along the centre axis 7 of the tool body 5. The different sizes of the wedges will cause the wedges to project at different lengths L1 and L2 from the outer surface 6 of the tool body 5.

FIG. 5 shows a cross-sectional view similar to that of FIG. 3. In FIG. 5, the downhole tool string further comprises a second displacement element 12B projecting from the second body half 9. The second displacement element 12B is arranged at an angle V of 0-120° from the first displacement element 12 along a circumference of the tool body 5.

Furthermore, it is shown in FIG. 5 that the downhole tool string further comprises a second distancing element 14B projecting from the first body half 8. The second distancing element 14B is arranged at an angle of 0-120° from the first distancing element 14 along a circumference 15 of the tool body 5. In FIG. 5, the second distancing elements 14, 14B are arranged at an angle of approximately 40°. In FIG. 5, the angle is approximately two times the angle α, but in another embodiment the angle may be more or less than two times the angle α. Hence, the first and second distancing elements may be equidistantly placed from the first radial direction R. Similarly, the distancing elements 14, 14*b* may be equidistantly placed from the first radial direction R along the circumference of the tool body 5.

As shown in FIGS. 1, 2A and 2B, the downhole tool string 1 comprises a first tool section 21 in which the operational machining tool 10 is arranged and a second tool section 22 in which the displacement element and the distancing element are arranged. By having the operational machining tool in the first tool section arranged in succession to the second tool section along the tool centre axis 7, the distancing element can be arranged in the same radial position as the drilling bit along the circumference of the tool body, as shown in FIG. 4, and projected in the same radial direction as the operational machining tool, as shown in FIG. 2B. The second tool section can thus also function as an anchoring section 23, while the displacement element and the distancing element are anchoring elements 24 anchoring the downhole tool string in the axial direction. As shown in FIGS. 2A and 2*b*, each of the displacement element 12 and the distancing element 14 has a first end 25 connected with the tool body and a second end 26 for abutment to the wall of the well tubular metal structure. Each second end 26 of the displacement element 12 and the distancing element 14 comprises a friction-enhancing element 27B, such as teeth. The tool housing 27 comprises a first opening 31 through which the distancing element 14 projects and a second opening 32 in the tool housing through which the displacement element 12 projects.

In FIG. 1, the downhole tool string 1 comprises two second tool sections 22, i.e. one second tool section on each side of the first tool section so that the operational machining tool 10 in the first tool section is stabilised from each end, stabilising the drilling process even further. FIG. 1 shows a downhole system 100 comprising the downhole tool string and a driving unit 30, such as a downhole tractor, for propelling the downhole tool string 1 forward in the well. The downhole system 100 is connected to and powered through a wireline 44.

In FIG. 3, the displacement element 12 and the distancing element 14 are projectable from the outer face by being displaceable radially outwards without pivoting around a fixed pivot point as earlier described. The displacement element and the distancing element are projectable from the outer face in that the whole displacement element and the whole distancing element are displaceable radially outwards, e.g. forming part of pistons moving in radially extending piston housings.

As shown in FIG. 2A, the tool body has an outer diameter OD, and the outer diameter OD may be less than 79 mm, preferably less than 54 mm, i.e. less than 2.125 inches. When having an outer tool diameter of less than 54 mm, space is so limited that there is no room for any fixed distancing element 14 on the outer face as all space is needed for providing enough radial extension of the operational machining tool, i.e. the drill bit, for it to extend sufficiently to drill a hole all the way through the wall of the production casing.

FIGS. 8A and 8B show an embodiment similar to the embodiment shown in FIGS. 6A and 6B.

FIG. 8A shows a retracted position, i.e. a first position, of the first displacement element 12 and the first distancing element 14. The displacement element 12 and the distancing element 14 are projectable by means of the mandrel 41 inside the tool body 5 being pushed in the direction of the arrow AR along the centre axis 7 of the tool body 5.

FIG. 8B shows a projected position, i.e. a second position, of the first displacement element 12 and the first distancing element 14 where the mandrel 41 is pushed to cause the parts of the displacement and distancing elements 12, 14 to project.

In FIGS. 8A and 8B, the displacement element 12 and the distancing element 14 comprise parts 60, 61 of different length, and hence the first length L1 and the second length L2 will become different in the projected state of the displacement element 12 and the distancing element 14. In this way, the distancing element provides a shorter distance to the wall of the well tubular metal structure than the displacing element. The distancing element thus ensures a short distance so that the swarf from e.g. a drilling operation can be led away from the drill bit.

A stroking tool is a tool providing an axial force, e.g. for moving the mandrel inside the tool body or for providing an axial force in order to release the operational machining tool from its engagement with the well tubular metal structure. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing", "production casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms 36 having wheels 35, wherein the wheels contact the inner surface of the casing for propelling the tractor and the tool forward in the casing. The downhole tractor comprises an electric motor 37 driving a pump 38 providing a presurised fluid for projecting the arms 36 and rotating the wheels 35. A downhole tractor is any kind of driving tool capable of pushing or pulling tools in a well downhole, such as a Well Tractor®. The downhole tool string further comprises a control unit 39 for controlling the tool string in relation to the power and signals from a wireline 44.

Although the invention has been described above in connection with preferred embodiments of the invention, it will be evident to a person skilled in the art that several modifications are conceivable without departing from the invention as defined by the following claims.

The invention claimed is:

1. A downhole tool string for displacing at least a tool section in a well in a radial direction in a wall of a well tubular metal structure extending along an axial direction in relation to the radial direction, comprising:

a tool body having an outer face and a tool centre axis along the axial direction, a centre plane extending along and enclosing the centre axis, dividing the tool body into a first body half and a second body half, the tool body having a common piston, an operational machining tool configured to perform a machining operation in the well tubular metal structure, and to extend from the outer face of the first body half in a first radial direction in relation to the tool centre axis, a first displacement element extendable from the outer face of the second body half of the tool body configured to displace the tool body towards the wall for arranging the operational machining tool close to the wall, the first displacement element being extendable between a retracted position and a projected position, wherein the downhole tool string further comprises a first distancing element extendable from the outer face of the first body half, the first distancing element having a retracted position and a projected position, and in the projected position of the first distancing element a distance is provided between the outer face and the wall of the well tubular metal structure, and wherein the first displacement element in the projected position extends from the outer face at a first length, and the first distancing element in the projected position extends from the outer face at a second length, the first length being longer than the second length, wherein each of the first displacement element and the first distancing element is operatively connected to the common piston, the first displacement element and the first distancing element being configured to be moved from their retracted positions to their projected positions by axial movement of the common piston, and wherein, in the retracted position of the first displacement element and the retracted position of the first distancing element, the first distancing element and the first displacement element are positioned within the outer face of the tool body, and, in the projected position of the first displacement element and the projected position of the first distancing element, the first distancing element and the first displacement element extend from within the tool body to the outside of the outer face of the tool body.

2. A downhole tool string according to claim 1, wherein the distance is less than 10 mm.

3. A downhole tool string according to claim 1, wherein the operational machining tool is a drill bit.

4. A downhole tool string according to claim 1, wherein the first length is more than 200% of the second length.

5. A downhole tool string according to claim 1, wherein the operational machining tool in a projected position has a third length before initiating the machining operation, and the second length is less than 50% of the third length.

6. A downhole tool string according to claim 1, wherein the operational machining tool in an initial projected position has a fourth length before initiating the machining operation, and the fourth length is equal to or shorter than the second length.

7. A downhole tool string according to claim 1, wherein the first distancing element is arranged at an angle of 0±90° from the operational machining tool along a circumference of the tool body.

8. A downhole tool string according to claim 1, wherein the first displacement element and the first distancing element are projectable by the same axial movement in the tool body.

9. A downhole tool string according to claim 1, wherein the first displacement element and the first distancing element are projectable by means of hydraulics.

10. A downhole tool string according to claim 1, further comprising a second displacement element projecting from the second body half and arranged at an angle of 0-120° from the first displacement element along a circumference of the tool body.

11. A downhole tool string according to claim 1, further comprising a second distancing element projecting from the first body half and arranged at an angle of 0-120° from the first distancing element along a circumference of the tool body.

12. A downhole tool string according to claim 1, wherein the displacement element and the distancing element are projectable from the outer face by pivoting around respective pivot points.

13. A downhole tool string according to claim 1, wherein the displacement element and the distancing element are projectable from the outer face by being displaceable radially outwards.

14. A downhole tool string according to claim 1, wherein the piston is configured to move the distancing element and the displacement element at the same time.

15. A downhole tool string according to claim 1, wherein the piston is configured to engage the distancing element at a first axial position and to engage the displacement element at a second axial position that is different than the first axial position.

16. A downhole system comprising the downhole tool string according to claim 1 and a downhole tractor configured to propel the downhole tool string forward in the well.

* * * * *